United States Patent [19]

Webb

[11] Patent Number: 4,859,831

[45] Date of Patent: Aug. 22, 1989

[54] FUSER SYSTEM

[75] Inventor: John L. Webb, Fairport, N.Y.

[73] Assignee: Xerox Corporation, Stamford, Conn.

[21] Appl. No.: 206,794

[22] Filed: Jun. 15, 1988

[51] Int. Cl.[4] ..... G03G 15/20

[52] U.S. Cl. ..... 219/216; 355/290; 355/309

[58] Field of Search ..... 219/216, 469, 470, 471; 355/3 FU

[56] References Cited

U.S. PATENT DOCUMENTS

| | | | |
|---|---|---|---|
| 3,249,738 | 5/1966 | Simm | 219/216 |
| 3,632,984 | 1/1972 | Brownscombe | 219/469 |
| 3,637,976 | 1/1972 | Ohta | 219/216 |
| 3,952,696 | 4/1976 | Saupe | 219/216 |
| 4,112,280 | 9/1978 | Saalsich et al. | 219/216 |
| 4,165,965 | 8/1979 | Bernardelli | 355/3 FU |
| 4,689,471 | 8/1987 | Pirwitz | 219/216 |

FOREIGN PATENT DOCUMENTS

| | | | |
|---|---|---|---|
| 56-52782 | 5/1981 | Japan | 355/3 FU |

OTHER PUBLICATIONS

Application entitled Improved Fuser System Utilizing a Pressure Web, by Robert G. Pirwitz mailed to U.S. Patent Office on Apr. 27, 1988.

*Primary Examiner*—Teresa J. Walberg

[57] ABSTRACT

A fusing system incorporates a thin fabric-like web to maintain copy sheets in biased contact with a fuser roll during a fusing operation. The copy sheets are introduced to the fusing area at an entrance nip formed by a blade member biased tangentially against the fuser roll. The copy sheets are fed into frictional engagement at this entrance nip, reducing the tending of the copy sheets to stall or buckle.

5 Claims, 2 Drawing Sheets

FUSER SYSTEM

BACKGROUND OF THE INVENTION AND INFORMATION DISCLOSURE STATEMENT

This invention relates generally to an electrophotographic copying apparatus, and more particularly, to the heat and pressure fixing of toner images formed on a copy substrate by direct contact with a heated fusing member.

In the process of xerography, a light image of an original to be copied is typically recorded in the form of a latent electrostatic image upon a photosensitive member with subsequent development of the latent image by the application of marking particles commonly referred to as toner. The visual toner image is typically transferred from the member to a copy substrate, such as a sheet of plain paper, with subsequent affixing of the image by one of several fusing techniques. A preferred fusing system applies both heat and pressure to the copy substrate.

In one prior art fusing system, a fuser roll is used which has an outer surface or covering of polytetrafluoroethylene or silicone rubber, the former being known by the trade name Teflon, to which a release agent such as silicone oil is applied, the thickness of the Teflon TM being on the order of several mils and the thickness of the oil being less than 1 micron. Silicone based oils which possesses a relatively low surface energy, have been found to be materials that are suitable for use in a heated fuser roll environment where Teflon TM constitutes the outer surface of the fuser roll. In practice, a thin layer of silicone oil is applied to the surface of the heated roll to form an interface between the roll surface and the toner images carried on the support material. Thus a low surface energy layer is presented to the toner as it passes through the fuser nip and thereby prevents toner from offsetting to the fuser roll surface.

While heat and pressure fusers of the type discussed above are desirable because of their thermal efficiency, they possess some disadvantages because of their mechanical complexity, cost, long warm-up times and paper wrinkling. A third type of system is known in the prior art which reduces or eliminates these undesirable characteristics. This system utilizes a relatively low mass fuser roll member of the type disclosed, for example, in U.S. Pat. No. 4,689,471 assigned to Xerox Corporation. As disclosed in this patent, a low mass heated fuser roll cooperates with an elongated web member comprising a woven fabric to form an extended fusing area. One end of the pressure web is fixed while the other end is biased into pressure engagement with the fuser roll to form an entrance nip. The pressure web is an enabling feature of this type of system but its effectiveness depends upon several factors such as the type of copy substrate media being used and relative humidity conditions. As an example, certain types of copy media are subject to stalling or jamming on the leading edge entrance of the fuser entrance nip. The pressure and location of the biasing means is therefore of critical importance. One mechanism for enhancing the lead edge feed for a system of this type is found in copending application assigned to the same assignee as the present invention, entitled "Improved Fuser System Utilizing A Pressure Web" and mailed to the U.S. Patent Office on Apr. 27, 1988. This application discloses a roller introduced between the pressure web and the fuser roll and adapted to be rotated by the fuser wall. While this mechanism has proved effective for most systems, there are certain environments and operating conditions in which an alternate feed system is desirable.

The present invention is, therefore directed to an improved fuser system for fixing toner images to a copy substrate, said apparatus comprising:

a fuser roll;

a pressure applying member in the form of a thin web having an elongated surface contacting said fuser roll to form a fusing nip therebetween, a blade member positioned so as to be in biased tangential contact with said fuser roll upstream from said fusing nip to form an entrance nip therebetween, and biasing means to provide a bias pressure to said web so as to produce a bias force for biasing the web into engagement with the fuser roll along said fusing nip area.

Further prior art believed to be material is U.S. Pat. No. 4,112,280 assigned to Eastman Kodak Company. The patent discloses an apparatus for heat processing a sheet of web material which includes a rotary drum and a guide web of low friction material and an idler web which cooperates with the moving drum to effect feed of the material through the processing path.

DETAILED DESCRIPTION OF THE INVENTION

Figure 1:
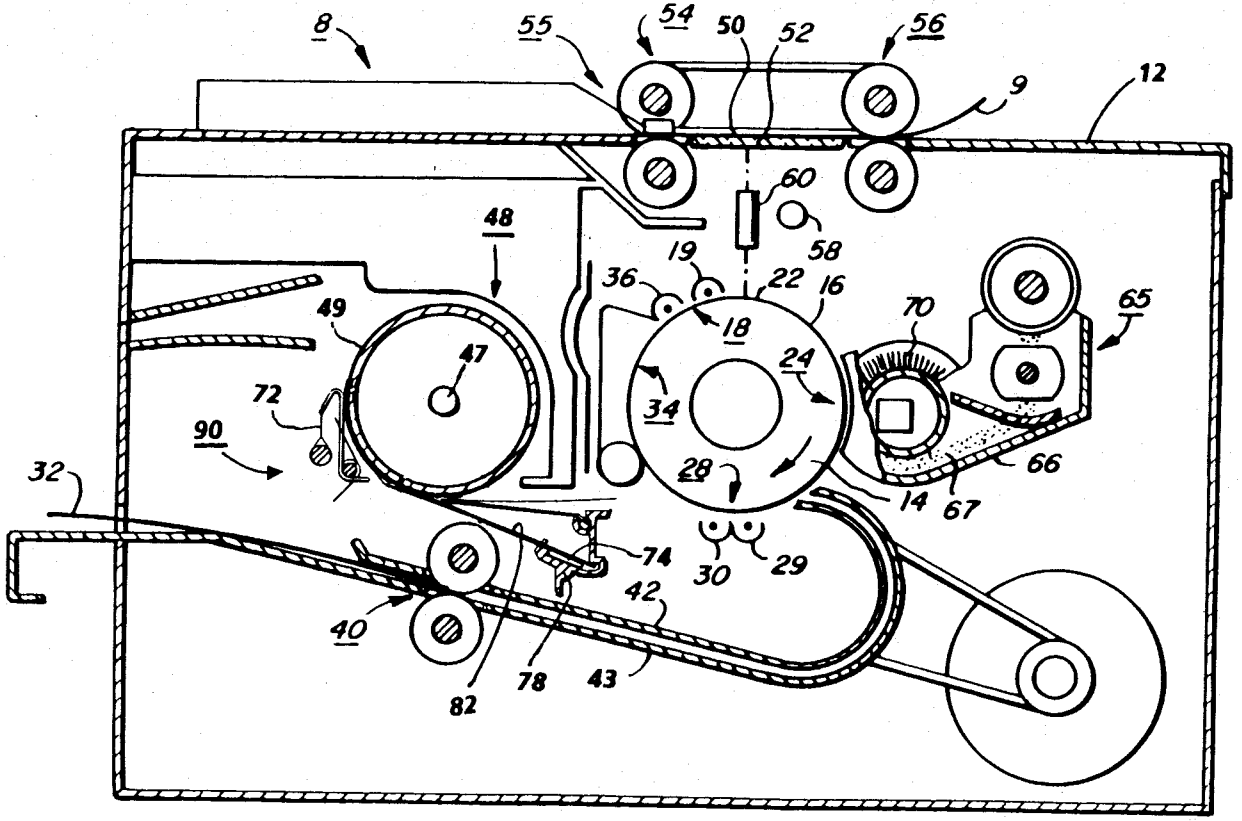
FIG. 1 is a side view in section of a reproduction machine having the improved fuser of the present invention.

Referring to FIG. 1 of the drawings, there is shown a xerographic-type reproduction machine 8 incorporating the present invention. Machine 8 has a suitable frame 12 on which the machine xerographic components are operatively supported. Briefly, as will be familiar to those skilled in the xerographic printing and copying arts, the xerographic components of the machine include a charge retentive recording member, shown here in the form of a rotatable photoreceptor 14. In the exemplary arrangement shown, photoreceptor 14 comprises a drum having a photoconductive surface 16. Other photoreceptor types such as belt, web, etc. may instead be employed. Operatively disposed about the periphery of the photoreceptor 14 are a charging station 18 with charge corotron 19 for placing a uniform charge on the photoconductive surface 16 of photoreceptor 14, exposure station 22 where the previously charged photoconductive surface 16 is exposed to image rays of a document 9 being copied or reproduced to thereby form a latent electrostatic image on the charge retentive surface; development station 24 where the latent electrostatic image created on photoconductive surface 16 is developed by toner; combination transfer and detack station 28 with transfer corotron 29 detack corotron 30 for sequentially transferring the developed image to a suitable copy substrate material such as a copy sheet 32 brought forward in timed relation with the developed image on photoconductive surface 16 and lessening the forces of attraction between the copy substrate and the charge retentive member;

cleaning station 34 and discharge corotron 36 for removing leftover developer from photoconductive surface 16 and neutralizing residual charges thereon.

A copy sheet 32 is brought forward to transfer station 28 by feed roll pair 40. Sheet guides 42, 43, serve to guide the sheet through an approximately 180 degree turn prior to the copy substrate reaching the transfer station 28. Following transfer, the sheet 28 is carried forward to a fusing station 48 where the toner image is contacted by fusing roll 49, forming one member of a heat and pressure fuser. Fusing roll 49 is heated by a suitable heater such as quartz lamp 50 disposed within the interior of roll 49. After fusing, the copy sheet 32 is discharged from the machine.

A transparent platen 50 supports the document 9 as the document is moved past a scan area 52 by a constant velocity type transport 54. As will be understood, scan area 52 is in effect a scan line extending across the width of platen 50 at a desired point along plate 50 where the document is scanned line by line as a document is moved along platen 50 by transport 54. Transport 54 has input and output document feed roll pairs 55, 56 respectively on each side of scan area 52 for moving document 9 across platen 50 at a predetermined speed. Exposure lamp 58 is provided to illuminate a strip-like area of platen 50 at scan area 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer 67. As will be understood by those skilled in the art, developer 67 comprises a mixture of larger carrier particles and smaller toner or ink particles. A rotatable magnetic brush developer roll 70 is disposed in a predetermined operative relation to the photoconductive surface 16 in developer housing 65, roll 70 serving to bring developer from sump 66 into developing relation with photoreceptor 14 to develop the latent electrostatic images formed on the photoconductive surface 16.

The fuser roll 49 comprises a thin-walled thermally conductive tube having a thin (i.e. approximately 0.005 inch (0.01 Centimeters)) coating of silicon rubber on the exterior surface thereof which contacts the toner images on the copy substrate to thereby affix them to the substrate. A release agent management system, not shown, applies a thin layer of silicone oil to the surface of the fuser roll for the prevention of toner offset thereto as well as reducing the torque required to effect rotation of the fuser roll. In one operative embodiment of the fuser roll its diameter was 3.3 inches and had a length of 40 inches. This embodiment is typically used to fuse images on copy substrates that are 3 feet (0.91 Meters) wide by 4 feet (1.22 Meters) in length.

The fuser apparatus 48 in the preferred embodiment also comprises a non-rotating, elongated pressure web member 72. As viewed in FIGS. 1 and 2, one end of web 72, which can be a thin fabric, forms a first loop or sleeve 74 which is fitted over a bar member 76. Bar member 76 is held firmly in place against a portion of the frame station 78. Also secured to frame station 78 by means of screw 80 is a blade member 82, which, in a preferred embodiment, is an elongated flexible stainless steel member. Blade member 82 is positioned such that a portion is in tangential contact with the surface of fuser roll 49 forming a first entrance nip 84 for the incoming copy sheet 32. The copy sheet is supported by bracket 84 during the course of its travel. The end of blade 28 extends a short distance beyond the entrance nip 84. Web 72 is then seen to extend against the bottom of blade member 82 and to come into contact with the fuser roll 49 at a point P downstream from the edge of member 82. Web 72 is biased into engagement with the fuser roll to form a second, elongated nip area 86 by means of a pressure applying mechanism 90.

Figure 2:
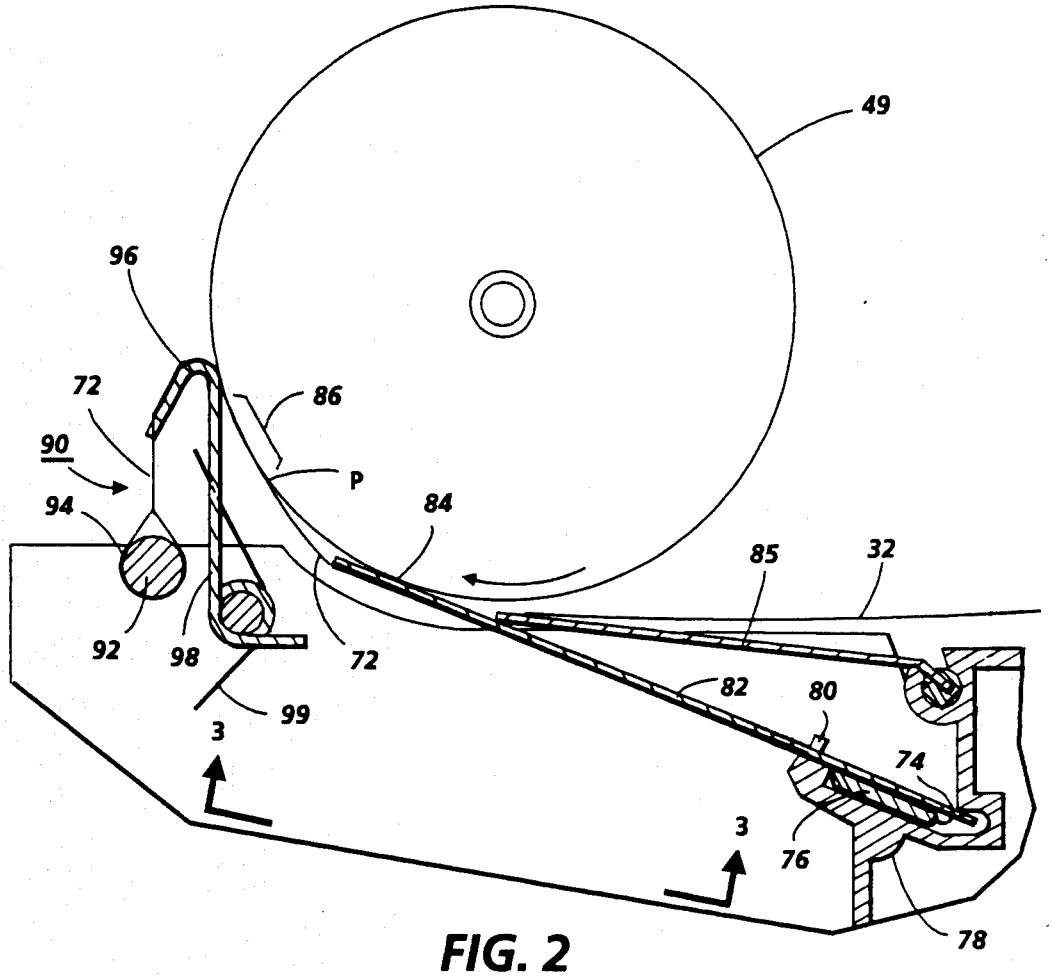
FIG. 2 is an enlarged view of a portion of the fuser shown in FIG. 1, showing the improved paper feed mechanism of the present invention.

Pressure applying mechanism 90 creates a force between the roll and web so as to produce a frictional force therebetween that keeps the web in tension so it can provide suitable pressure to the surface of the fuser roll, along pressure nip area 86. Mechanism 90 encompasses a weighted rod 92 disposed in a loop 94 formed in web 72. A portion of the web intermediate the two ends thereof rides over a curved portion 96 of a web frame or support member 98. A biasing force is applied to the frame or support member 98 by leaf spring 99 to thereby urge the web 72 into engagement with the fuser roll 49. The force so applied is just sufficient to keep the web against the roll along nip area 88. Blade member 82 is biased into line contact with roller 49 by virtue of a bending force that is developed when the paper transport assembly is in the normal operating position as shown in FIG. 2. Blade member 82 develops about 14 pounds total pressure to control and prevent paper cockle and wrinkle.

Figure 3:
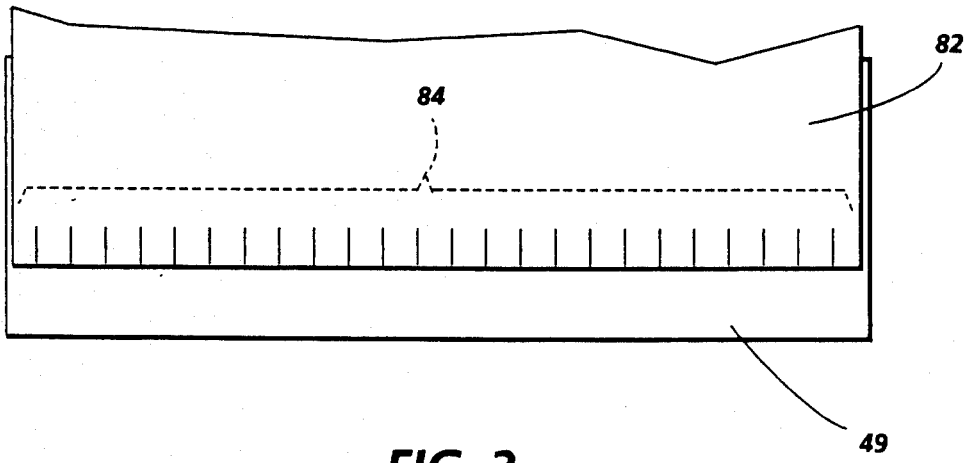
FIG. 3 is a front view of a portion of the fuser system showing a copy sheet entering the nip area.

FIG. 3 shows a partial bottom view of a portion of the fuser assembly showing the nip area 84. The end of blade member 82 extends a short distance beyond the nip area. As seen, the edge surface of blade member 82 has a plurality of parallel slots extending in the direction of sheet travel. These slots have been found to impart a uniform feed motion to the copy paper.

In operation, and referring to FIGS. 1–3, a sheet of copy paper bearing a transferred xerographic toner image, enters the fusing area by first traveling along the top surface of bracket 85. The leading edge of the copy sheet is then engaged at the first nip 84 formed at the interface of blade member 82 and fuser roll 49. Interface 84 presents a low friction engaging surface to most types of copy media and serves to reduce stalling or jamming of the leading edge of the copy sheet. The leading edge of the sheet moves through the first entrance and is subsequently engaged by the second, elongated nip area 86 formed between the surface of web 72 and the surface of fuser roll 42. The toner image is permanently fused to the copy sheet as it travels through this extended nip area.

In summary, a fuser system has been described which includes an improved mechanism for feeding copy sheets into the fuser area. The blade member, while described as being constructed of stainless steel in a preferred embodiment, may also be made of other materials such as aluminum, or have a surface coating of a material such as Teflon TM, which would reduce the frictional forces at the entrance nip.

While the invention has been described with reference to the structure disclosed, it is not confined to the specific details set forth, but is intended to cover such modifications or changes as may come within the scope of the following claims:

What is claimed is:

1. An improved fuser system for fixing toner images to a copy substrate, said apparatus comprising:

a fuser roll;

a pressure applying member in the form of a thin web having an elongated surface contacting said fuser roll to form a fusing nip therebetween, a blade member positioned so as to be in biased tangential contact directly with the surface of said fuser roll upstream from said fusing nip to form an entrance nip therebetween, and biasing means to provide a bias pressure to said web so as to produce a bias force to bias the web into engagement with the fuser roll along said fusing nip area.

2. The fuser system of claim 1, wherein said web is anchored, at both ends, in a frame member.

3. The fuser system of claim 1, wherein said blade member has one end anchored in a frame member with the second end extending beyond the entrance nip area.

4. The fuser system of claim 3, wherein the portion of said blade member extending beyond said nip area has a plurality of parallel slots formed adjacent the edge aligned in the direction of paper travel.

5. The fuser system of claim 1, wherein the blade member is biased into contact with the fuser roll by approximately 14 pounds total pressure.

* * * * *